US005709719A

United States Patent [19]

Cherpeck

[11] Patent Number: 5,709,719

[45] Date of Patent: Jan. 20, 1998

[54] POLY(OXYALKYLENE) ESTERS OF SUBSTITUTED POLYPHENYLETHERS AND FUEL COMPOSITIONS CONTAINING THE SAME

[75] Inventor: Richard E. Cherpeck, Cotati, Calif.

[73] Assignee: Chevron Chemical Company, San Ramon, Calif.

[21] Appl. No.: 778,199

[22] Filed: Dec. 30, 1996

[51] Int. Cl.[6] ..... C10L 1/22

[52] U.S. Cl. ..... 44/399; 44/400; 560/19; 560/20; 560/21; 560/48; 560/50

[58] Field of Search ..... 560/19, 20, 21, 560/23, 39, 48, 50; 44/399, 400

[56] References Cited

U.S. PATENT DOCUMENTS

| | | | |
|---|---|---|---|
| 4,191,537 | 3/1980 | Lewis et al. . | |
| 4,881,945 | 11/1989 | Buckley . | |
| 5,081,295 | 1/1992 | Reardan et al. | 564/163 |
| 5,090,914 | 2/1992 | Reardan et al. | 435/188 |
| 5,103,039 | 4/1992 | Reardan et al. | 560/33 |
| 5,157,099 | 10/1992 | Reardan et al. | 528/68 |
| 5,211,721 | 5/1993 | Sung et al. | 44/389 |
| 5,407,452 | 4/1995 | Cherpeck | 44/399 |
| 5,427,591 | 6/1995 | Cherpeck | 44/400 |
| 5,538,521 | 7/1996 | Cherpeck | 44/389 |
| 5,540,743 | 7/1996 | Cherpeck | 44/399 |

*Primary Examiner*—Prince Willis, Jr.
*Assistant Examiner*—Cephia D. Toomer
*Attorney, Agent, or Firm*—Claude J. Caroli

[57] ABSTRACT

A poly(oxyalkylene) ester of a substituted polyphenylether having the formula:

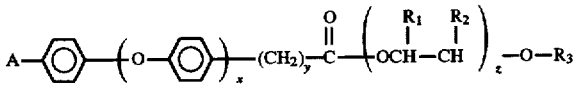

wherein A is amino, aminomethyl, cyano, nitro, N-alkylamino or N-alkylaminomethyl wherein the alkyl group contains about 1 to about 6 carbon atoms, or N,N-dialkylamino or N,N-dialkylaminomethyl wherein each alkyl group independently contains about 1 to about 6 carbon atoms; $R_1$ and $R_2$ are independently hydrogen or lower alkyl having about 1 to about 6 carbon atoms and each $R_1$ and $R_3$ is independently selected in each —O—$CHR_1$-$CHR_2$- unit; $R_3$ is hydrogen, alkyl having about 1 to about 100 carbon atoms, phenyl, aralkyl having about 7 to about 100 carbon atoms or alkaryl having about 7 to about 100 carbon atoms; x is an integer from about 1 to about 10, y is an integer from 0 to about 10; and z is an integer from about 1 to about 100. The poly(oxyalkylene) esters of the substituted polyphenylethers of the present invention are useful as fuel additives for the prevention and control of engine deposits.

27 Claims, No Drawings

POLY(OXYALKYLENE) ESTERS OF SUBSTITUTED POLYPHENYLETHERS AND FUEL COMPOSITIONS CONTAINING THE SAME

BACKGROUND OF THE INVENTION

1. Field of the Invention

This invention relates to poly(oxyalkylene) esters of substituted polyphenylethers and to fuel compositions containing poly(oxyalkylene) esters of substituted polyphenylethers to prevent and control engine deposits.

2. Description of the Related Art

It is well known that automobile engines tend to form deposits on the surface of engine components, such as carburetor ports, throttle bodies, fuel injectors, intake ports and intake valves, due to the oxidation and polymerization of hydrocarbon fuel. These deposits, even when present in relatively minor amounts, often cause noticeable driveability problems, such as stalling and poor acceleration. Moreover, engine deposits can significantly increase an automobile's fuel consumption and production of exhaust pollutants. Therefore, the development of effective fuel detergents or "deposit control" additives to prevent or control such deposits is of considerable importance and numerous such materials are known in the art.

For example, polyether amine fuel additives are well known in the art for the prevention and control of engine deposits. These polyether additives have a polyoxyalkylene "backbone", i.e., the polyether portion of the molecule consists of repeating oxyalkylene units. U.S. Pat. No. 4,191,537, issued Mar. 4, 1980 to Lewis et al., for example, discloses a fuel composition comprising a major portion of hydrocarbons boiling in the gasoline range and from 30 to 2,000 ppm of a hydrocarbyl polyoxyalkylene aminocarbamate having a molecular weight from about 600 to 10,000, and at least one basic nitrogen atom. The hydrocarbyl polyoxyalkylene moiety is composed of oxyalkylene units having from 2 to 5 carbon atoms in each oxyalkylene unit. These fuel compositions are taught to maintain the cleanliness of intake systems without contributing to combustion chamber deposits.

Aromatic compounds containing a poly(oxyalkylene) moiety are also known in the art. For example, the above-mentioned U.S. Patent No. 4,191,537, discloses alkylphenyl poly(oxyalkylene) polymers which are useful as intermediates in the preparation of alkylphenyl poly(oxyalkylene) aminocarbamates.

Similarly, U.S. Pat. No. 4,881,945, issued Nov. 21, 1989 to Buckley, discloses a fuel composition comprising a hydrocarbon boiling in the gasoline or diesel range and from about 30 to about 5,000 parts per million of a fuel soluble alkylphenyl polyoxyalkylene aminocarbamate having at least one basic nitrogen and an average molecular weight of about 800 to 6,000 and wherein the alkyl group contains at least 40 carbon atoms.

U.S. Pat. No. 5,090,914, issued Feb. 25, 1992 to Reardan et al., discloses poly(oxyalkylene) aromatic compounds having an amino or hydrazinocarbonyl substituent on the aromatic moiety and an ester, amide, carbamate, urea or ether linking group between the aromatic moiety and the poly (oxyalkylene) moiety. These compounds are taught to be useful for modifying macromolecular species such as proteins and enzymes. U.S. Pat. Nos. 5,081,295; 5,103,039; and 5,157,099; all issued to Reardan et al., disclose similar poly(oxyalkylene) aromatic compounds.

Certain poly(oxyalkylene) esters have been shown to reduce engine deposits when used in fuel compositions. U.S. Pat. No. 5,211,721, issued May 18, 1993 to Sung et al., for example, discloses an oil soluble polyether additive comprising the reaction product of a polyether polyol with an acid represented by the formula RCOOH in which R is a hydrocarbaryl radical having 6 to 27 carbon atoms. The poly(oxyalkylene) ester compounds of this patent are taught to be useful for inhibiting carbonaceous deposit formation, motor fuel hazing, and as ORI inhibitors when employed as soluble additives in motor fuel compositions.

U.S. Pat. No. 5,407,452, issued Apr. 18, 1995 to Cherpeck, discloses fuel compositions containing a major amount of hydrocarbons boiling in the gasoline or diesel range and an effective deposit-controlling amount of a poly(oxyalkylene) aromatic ester having an amino, N-alkylamino, N,N-dialkylamino, or nitro substituent on the aromatic moiety are surprisingly useful for reducing engine deposits, especially intake valve deposits, when employed as fuel additives in fuel compositions.

Still further, U.S. Pat. No. 5,427,591, issued Jun. 27, 1995 to Cherpeck, discloses poly(oxyalkylene)hydroxyaromatic esters having a poly(oxyalkylene) "tail" provide excellent control of engine deposits, especially intake valve deposits, when employed as fuel additives in fuel compositions.

U.S. Pat. No. 5,538,521, issued Jul. 23, 1996 to Cherpeck, discloses certain polyalkyl and poly(oxyalkylene) aromatic esters which are substituted on the aromatic moiety with a thoether, a sulfoxide, a sulfone, a sulfonic acid, a sulfonamide, a nitrile, a carboxylic acid or ester, or a carboximide, are surprisingly useful for reducing engine deposits, especially intake valve deposits, when employed as fuel additives in fuel compositions.

U.S. Pat. No. 5,540,743, issued Jul. 30, 1996 to Cherpeck, relates to polyalkyl and poly(oxyalkylene)benzyl amine esters and to fuel compositions containing the same. More particularly, this patent discloses that certain polyalkyl and poly(oxyalkylene)benzyl amine esters are useful in fuel compositions to prevent and control engine deposits, especially intake valve deposits.

My commonly assigned copending U.S. Patent application Ser. No. 08/581,658, filed Dec. 29, 1995, discloses a novel fuel-soluble substituted aromatic polyalkyl ether fuel additive which is useful for the prevention and control of engine deposits, particularly intake valve deposits, when employed as fuel additives in fuel compositions.

It has now been discovered that certain poly(oxyalkylene) esters of substituted polyphenylethers are surprisingly useful for reducing engine deposits, especially intake valve deposits, when employed as fuel additives in fuel compositions.

SUMMARY OF THE INVENTION

The present invention provides novel fuel-soluble poly (oxyalkylene) esters of substituted polyphenylether fuel additives which are useful for the prevention and control of engine deposits, particularly intake valve deposits.

The fuel-soluble poly(oxyalkylene) esters of the substituted polyphenylethers of the present invention have the formula:

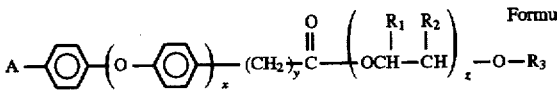

Formula I wherein A is amino, aminomethyl, cyano, nitro, N-alkylamino or N-alkylaminomethyl wherein the alkyl group contains about 1 to about 6 carbon atoms, or N,N-dialkylamino or N,N-dialkylaminomethyl wherein each alkyl group independently contains about 1 to about 6 carbon atoms; $R_1$ and $R_2$ are independently hydrogen or lower alkyl having about 1 to about 6 carbon atoms and each $R_1$ and $R_2$ is independently selected in each —O—$CHR_1$-$CHR_2$- unit; $R_3$ is hydrogen, alkyl having about 1 to about 100 carbon atoms, phenyl, aralkyl having about 7 to about 100 carbon atoms, or alkaryl having about 7 to about 100 carbon atoms.

x is an integer from about 1 to about 10; y is an integer from 0 to about 10; and z is an integer from about 1 to about 100.

The present invention further provides a fuel composition comprising a major amount of hydrocarbons boiling in the gasoline or diesel range and an effective deposit-controlling amount of a poly(oxyalkylene) ester of a substituted polyphenylether.

The present invention further provides a fuel concentrate comprising an inert stable oleophilic organic solvent boiling in the range of from about 150° F. (65° C.) to about 400° F. (205° C.) and from about 10 to about 70 weight percent of a poly(oxyalkylene) ester of a substituted polyphenylether of formula I above.

The present invention also provides a method for reducing engine deposits in an internal combustion engine comprising operating the engine with a fuel composition containing an effective deposit-controlling amount of a poly(oxyalkylene) ester of a substituted polyphenylether of formula I above.

Among other factors, the present invention is based on the surprising discovery that certain substituted poly (oxyalkylene) esters of substituted polyphenylethers provide excellent control of engine deposits, especially on intake valves, when employed as fuel additives in fuel compositions.

DETAILED DESCRIPTION OF THE INVENTION

The fuel-soluble poly(oxyalkylene) esters of the substituted polyphenylethers of the present invention have the general formula:

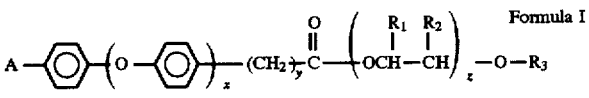

Formula I wherein A, $R_1$, $R_2$, $R_3$, X, y, and z are as defined above.

In formula I, A is preferably an amino or aminomethyl group. Most preferably, A is an amino group.

Preferably, one of $R_1$ and $R_2$ is lower alkyl having about 1 to about 3 carbon atoms and the other is hydrogen. More preferably, one of $R_1$ and $R_2$ is methyl or ethyl and the other is hydrogen. Most preferably, one of $R_1$ and $R_2$ is ethyl and the other is hydrogen.

$R_3$ is preferably hydrogen, alkyl having about 1 to about 30 carbon atoms, or alkylphenyl having an alkyl group containing about 1 to about 30 carbon atoms. More preferably, $R_3$ is hydrogen, alkyl having about 2 to about 24 carbon atoms, or alkylphenyl having an alkyl group containing about 2 to about 24 carbon atoms. Still more preferably, $R_3$ is hydrogen, alkyl having about 4 to about 12 carbon atoms or alkylphenyl having an alkyl group containing about 4 to about 12 carbon atoms. Most preferably, $R_3$ is alkylphenyl having an alkyl group containing about 4 to about 12 carbon atoms.

Preferably, x is an integer from about 1 to about 10. Most preferably, x is 1. Preferably, y is an integer from 0 to about 10. Most preferably, y is 0. Preferably, z is an integer from about 1 to about 50. Most preferably, z is an integer from about 1 to about 30.

When A is an N-alkylamino group, the alkyl group of the N-alkylamino moiety preferably contains about 1 to about 4 carbon atoms. More preferably, the alkyl group is methyl or ethyl. For example, particularly preferred N-alkylamino groups are N-methylamino and N-ethylamino groups.

Similarly, when A is an N,N-dialkylamino group, each alkyl group of the N,N-dialkylamino moiety preferably contains about 1 to about 4 carbon atoms. More preferably, each alkyl group is either methyl or ethyl. For example, particularly preferred N,N-dialkylamino groups are N,N-dimethylamino, N-ethyl-N-methylamino and N,N-diethylamino groups.

A preferred group of poly(oxyalkylene) esters of the substituted polyphenylethers for use in this invention are compounds of formula I wherein A is amino or aminomethyl; one of $R_1$ and $R_2$ is hydrogen and the other is methyl or ethyl; $R_3$ is hydrogen, alkyl having about 1 to about 30 carbon atoms or alkylphenyl having an alkyl group containing about 1 to about 30 carbon atoms; x is about 1; y is 0; and z is about 1 to about 50.

A more preferred group of poly(oxyalkylene) esters of the substituted polyphenylethers are those of formula I wherein A is amino; one of $R_1$ and $R_2$ is hydrogen and the other is methyl or ethyl; $R_3$ is hydrogen, alkyl having about 2 to about 24 carbon atoms or alkylphenyl having an alkyl group containing about 2 to about 24 carbon atoms; x is about 1; y is 0, and z is about 1 to about 50.

It is especially preferred that the amino, aminomethyl, cyano, nitro, N-alkylamino or N-alkylaminomethyl, N,N-dialkylamino or N,N-dialkylaminomethyl substituent, present in the aromatic moiety of the poly(oxyalkylene) esters of the substituted polyphenylethers of this invention be situated in a meta or para position relative to the polyphenylether moiety.

The poly(oxyalkylene) esters of the substituted polyphenylethers employed in the present invention will generally have a sufficient molecular weight so as to be non-volatile at normal engine intake valve operating temperatures (about 200° C. to about 250° C.). Typically, the molecular weight of the poly(oxyalkylene) esters of the substituted polyphenylethers will range from about 600 to about 10000, preferably from about 1000 to about 3000.

Generally, the poly(oxyalkylene) esters of the substituted polyphenylethers in this invention will contain an average of about 1 to about 100 oxyalkylene units; preferably, about 1 to about 50 oxyalkylene units; more preferably, about 1 to about 30 oxyalkylene units.

Fuel-soluble salts of the poly(oxyalkylene) esters of the substituted polyphenylethers in the present invention can be readily prepared for those compounds containing an amino, N-alkylamino or N-alkylaminomethyl or N,N dialkylamino or N,N-dialkylaminomethyl group and such salts are contemplated to be useful for preventing or controlling engine deposits. Suitable salts include, for example, those obtained by protonating the amino moiety with a strong organic acid, such as an alkyl- or arylsulfonic acid. Preferred salts are derived from toluenesulfonic acid and methanesulfonic acid.

DEFINITIONS

As used herein, the following terms have the following meanings unless expressly stated to the contrary.

The term "amino" refers to the group: —$NH_2$.

The term "aminomethyl" refers to the group: —$CH_2NH_2$.

The term "cyano" refers to the group: —CN.

The term "nitro" refers to the group: —$NO_2$.

The term "N-alkylamino" refers to the group: —$NHR_a$ wherein $R_a$ is an alkyl group. The term "N,N-dialkylamino" refers to the group: —$NR_bR_c$, wherein $R_b$ and $R_c$ are alkyl groups.

The term "N-alkylaminomethyl" refers to the group: —$CH_2NHR_d$ wherein $R_d$ is an alkyl group. The term "N,N-dialkylaminomethyl" refers to the group: —$CH_2NR_eR_f$, wherein $R_e$ and $R_f$ are alkyl groups.

The term "alkyl" refers to both straight- and branched-chain alkyl groups.

The term "lower alkyl" refers to alkyl groups having about 1 to about 6 carbon atoms and includes primary, secondary, and tertiary alkyl groups. Typical lower alkyl groups include, for example, methyl, ethyl, n-propyl, isopropyl, n-butyl, sec-butyl, t-butyl, n-pentyl, n-hexyl, and the like.

The term "lower alkoxy" refers to the group —$OR_g$ wherein $R_g$ is lower alkyl. Typical lower alkoxy groups include methoxy, ethoxy, and the like.

The term "alkaryl" refers to the group:

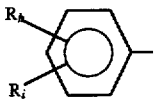

wherein $R_h$ and $R_i$ are each independently hydrogen or an alkyl group, with the proviso that both $R_h$ and $R_i$ are not hydrogen. Typical alkaryl groups include, for example, tolyl, xylyl, cumenyl, ethylphenyl, butylphenyl, dibutylphenyl, hexylphenyl, octylphenyl, dioctylphenyl, nonylphenyl, decylphenyl, didecylphenyl, dodecylphenyl, hexadecylphenyl, octadecylphenyl, icosylphenyl, tricontylphenyl, and the like. The term "alkylphenyl" refers to an alkaryl group of the above formula in which $R_h$ is alkyl and $R_i$ is hydrogen.

The term "aralkyl" refers to the group:

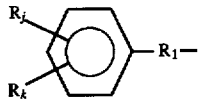

wherein $R_j$ and $R_k$ are each independently hydrogen or an alkyl group; and $R_l$ is an alkylene group. Typical alkaryl groups include, for example, benzyl, methylbenzyl, dimethylbenzyl, phenethyl, and the like.

The term "oxyalkylene unit" refers to an ether moiety having the general formula:

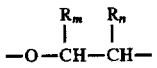

wherein $R_m$ and $R_n$ are each independently hydrogen or lower alkyl groups.

The term "poly(oxyalkylene)" refers to a polymer or oligomer having the general formula:

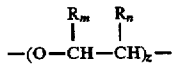

wherein $R_m$ and $R_n$ are as defined above, and z is an integer from about 1 to about 100. When referring herein to the number of poly(oxyalkylene) units in a particular poly (oxyalkylene) compound, it is to be understood that this number refers to the average number of poly(oxyalkylene) units in such compounds unless expressly stated to the contrary. It is also to be understood that the term "poly (oxyalkylene)" includes compounds containing one oxyalkylene unit.

GENERAL SYNTHETIC PROCEDURES

The poly(oxyalkylene) esters of the substituted polyphenylethers in this invention can be prepared by the following general methods and procedures. Those skilled in the art will recognize that where typical or preferred process conditions (e.g., reaction temperatures, times, mole ratios of reactants, solvents, pressures, etc.) are given, other process conditions may also be used unless otherwise stated. Optimum reaction conditions may vary with the particular reactants or solvents used, but one skilled in the art will be able to determine such conditions by routine optimization procedures.

Moreover, those skilled in the art will recognize that it may be necessary to block or protect certain functional groups while conducting the following synthetic procedures. In such cases, the protecting group will serve to protect the functional group from undesired reactions or to block its undesired reaction with other functional groups or with the reagents used to carry out the desired chemical transformations. The proper choice of a protecting group for a particular functional group will be readily apparent to one skilled in the art. Various protecting groups and their introduction and removal are described, for example, in T. W. Greene and P. G. M. Wuts, *Protective Groups in Organic Synthesis*, Second Edition, Wiley, New York, 1991, and references cited therein.

In the present synthetic procedures, a hydroxyl group will preferably be protected, when necessary, as the benzyl or tert-butyldimethylsilyl ether. Introduction and removal of these protecting groups is well described in the art. Amino groups may also require protection and this may be accomplished by employing a standard amino protecting group, such as a benzyloxycarbonyl or a trifluoroacetyl group. Additionally, as will be discussed in further detail hereinbelow, the poly(oxyalkylene) esters of the substituted polyphenylethers of this invention having an amino group on the aromatic moiety will generally be prepared from the corresponding nitro derivative. Accordingly, in many of the following procedures, a nitro group will serve as a protecting group for the amino moiety. Moreover, the compounds of this invention having a —$CH_2NH_2$ group on the aromatic moiety will generally be prepared from the corresponding cyano derivative, —CN. Thus, in many of the following procedures, a cyano group will serve as a protecting group for the —$CH_2NH_2$ moiety.

The poly(oxyalkylene) esters of the substituted polyphenylethers of the present invention wherein x is about 1 may be prepared by first esterifying an aromatic carboxylic acid having the formula:

Formula II

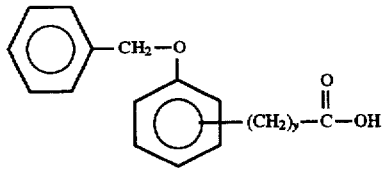

with a poly(oxyalkylene) alcohol having the formula:

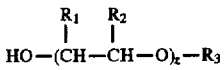

Formula III wherein $R_1$–$R_3$, y and z are as defined above, using conventional esterification reaction conditions.

This reaction is typically conducted by contacting poly (oxyalkylene) alcohol III with about 0.90 to about 1.5 molar equivalents of aromatic carboxylic acid II in the presence of an acidic catalyst at a temperature in the range of about 70° C. to about 160° C. for about 0.5 to about 48 hours. Suitable acid catalysts for this reaction include, for example, p-toluenesulfonic acid, methanesulfonic acid, sulfuric acid, and the like. The reaction may be conducted in the presence or absence of an inert solvent, such as toluene, xylene, and the like. The water generated during this reaction may be continuously removed by conventional procedures, such as azeotropic distillation with an inert solvent, such as xylene.

Alternatively, the poly(oxyalkylene) esters of the substituted polyphenylethers of formula I may be prepared by reacting poly(oxyalkylene) alcohol III with an acid halide derived from aromatic carboxylic acid II, such as an acid bromide or acid chloride.

Generally, the carboxylic acid moiety of formula II may be converted into an acyl halide moiety by contacting II with an inorganic acid halide, such as thionyl chloride, phosphorous trichloride, phosphorous tribromide, or phosphorous pentachloride; or with oxalyl chloride. Typically, this reaction will be conducted using about 1 to about 5 molar equivalents of the inorganic acid halide or oxalyl chloride, either neat or in an inert solvent, such as diethyl ether, at a temperature in the range of about 20° C. to about 80° C. for about 1 to about 48 hours. A catalyst, such as N,N-dimethylformamide, may also be used in this reaction.

Reaction of the acid halide derived from formula II with poly(oxyalkylene) alcohol III and subsequent removal of the benzyl ether moiety provides a poly(oxyalkylene) aromatic ester having the formula IV shown below.

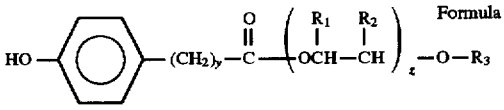

Formula IV wherein $R_1$–$R_3$, y and z are as defined above.

Typically, this reaction is conducted by contacting III with about 0.9 to about 1.5 molar equivalents of the acid halide in an inert solvent, such as toluene, dichloromethane, diethyl ether, and the like, at a temperature in the range of about 25° C. to about 150° C. The reaction is generally complete in about 0.5 to about 48 hours. Preferably, the reaction is conducted in the presence of a sufficient amount of an amine capable of neutralizing the acid generated during the reaction, such as triethylamine, di(isopropyl)ethylamine, pyridine, or 4-dimethylaminopyridine. Catalyst such as scandium trifluoromethane sulfonate or tributylphosphine also be used to facilitate the esterification reaction. Cleavage of the benzyl ether using conventional hydrogenolysis procedures then provides the above formula IV.

Where x is about 2 to about 10, the structure of formula IV may be further reacted with a suitable amount of a protected hydroxyaromatic halide having the formula:

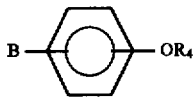

Formula V wherein B is a halide, such as chloride or bromide, and $R_4$ is a suitable hydroxy protecting group, such as benzyl, utilizing the Ullmann ether condensation, to give an aromatic ether having the formula:

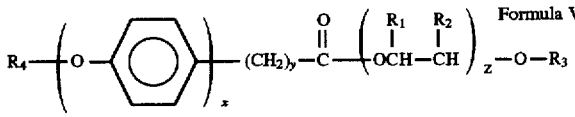

Formula VI wherein $R_1$–$R_4$, x, y and z are defined as above.

The aromatic carboxylic acids of formula II employed in the above-described procedures are either known compounds or can be prepared from known compounds by conventional procedures. Representative aromatic carboxylic acids suitable for use in these reactions include, for example, 3-benzyloxybenzoic acid and 4-benzyloxybenzoic acid. 4-Benzyloxybenzoic acid is preferred.

The poly(oxyalkylene) alcohols of formula III are also known compounds that can be prepared using conventional procedures. For example, suitable procedures for preparing such compounds are taught in U.S. Pat. Nos. 2,782,240 and 2,841,479, the disclosures of which are incorporated herein by reference.

Preferably, the poly(oxyalkylene) alcohols of formula III are prepared by contacting an alkoxide or phenoxide metal salt having the formula:

$R_3$-O-M

Formula VII wherein $R_3$ is as defined above and M is a metal cation, such as lithium, sodium, potassium, and the like, with about 1 to about 100 molar equivalents of an alkylene oxide (an epoxide) having the formula:

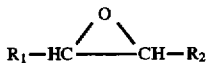

Formula VIII wherein $R_1$ and $R_2$ are as defined above.

Typically, metal salt VII is prepared by contacting the corresponding hydroxy compound $R_3OH$ with a strong base, such as sodium hydride, potassium hydride, sodium amide, and the like, in an inert solvent, such as toluene, xylene, and the like, under substantially anhydrous conditions at a temperature in the range from about −10° C. to about 120° C. for about 0.25 to about 3 hours.

Metal salt VII is generally not isolated, but is reacted in situ with alkylene oxide VIII to provide, after neutralization, the poly(oxyalkylene) alcohol III. This polymerization reaction is typically conducted in a substantially anhydrous inert solvent at a temperature of about 30° C. to about 150° C. for about 2 to about 120 hours. Suitable solvents for this reaction include toluene, xylene, and the like. Typically, the reaction is conducted at a pressure sufficient to contain the reactants and the solvent, preferably at atmospheric or ambient pressure.

The amount of alkylene oxide employed in this reaction will generally depend on the number of oxyalkylene units desired in the product. Typically, the molar ratio of alkylene oxide VIII to metal salt VII will range from about 1:1 to about 100:1; preferably, from 1:1 to 50:1, more preferably from 1:1 to 30:1.

Alkylene oxides suitable for use in this polymerization reaction include, for example, ethylene oxide; propylene oxide; butylene oxides, such as 1,2-butylene oxide (1,2-epoxybutane) and 2,3-butylene oxide (2,3-epoxybutane); pentylene oxides; hexylene oxides; octylene oxides; and the like. Preferred alkylene oxides are propylene oxide and 1,2-butylene oxide.

In the polymerization reaction, a single type of alkylene oxide may be employed, e.g., propylene oxide, in which case the product is a homopolymer, e.g., a poly(oxypropylene) polymer. Copolymers are equally satisfactory and random copolymers can be prepared by contacting metal salt VII with a mixture of alkylene oxides, such as a mixture of propylene oxide and 1,2-butylene oxide, under polymerization conditions. Copolymers containing blocks of oxyalkylene units are also suitable for use in this invention. Block copolymers can be prepared by contacting metal salt VII with first one alkylene oxide, then others in any order, or repetitively, under polymerization conditions.

Poly(oxyalkylene) copolymers prepared by terminating or capping the poly(oxyalkylene) moiety with about 1 to about 10 oxyethylene units, preferably about 2 to about 5 oxyethylene units, are particularly useful in the present invention, since these copolymers have been found to be more readily esterified than those having an alkyl branch in the terminal oxyalkylene unit. These copolymers may be prepared by contacting metal salt VII with an alkylene oxide of formula VIII, such as 1,2-butylene oxide or propylene oxide, under polymerization conditions and then capping or terminating the resulting block of oxyalkylene units with oxyethylene units by adding ethylene oxide.

The poly(oxyalkylene) alcohol III may also be prepared by living or immortal polymerization as described by S. Inoue and T. Aida in *Encyclopedia of Polymer Science and Engineering*, Second Edition, Supplemental Volume, J. Wiley and Sons, New York, pages 412–420 (1989). These procedures are especially useful for preparing poly (oxyalkylene) alcohols of formula III in which $R_1$ and $R_2$ are both alkyl groups.

As noted above, the alkoxide or phenoxide metal salt VII used in the above procedures is generally derived from the corresponding hydroxy compound, $R_3OH$. Suitable hydroxy compounds include straight- or branched-chain aliphatic alcohols having about 1 to about 100 carbon atoms and phenols having the formula:

Formula IX

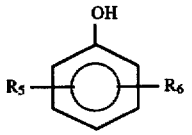

wherein $R_5$ is an alkyl group having about 1 to about 100 carbon atoms and $R_6$ is hydrogen; or $R_5$ and $R_6$ are both alkyl groups, each independently containing about 1 to about 50 carbon atoms.

Representative examples of straight- or branched-chain aliphatic alcohols suitable for use in this invention include, but are not limited to, n-butanol; isobutanol; sec-butanol; t-butanol; n-pentanol; n-hexanol; n-heptanol; n-octanol; isooctanol; n-nonanol; n-decanol; n-dodecanol; n-hexadecanol (cetyl alcohol); n-octadecanol (stearyl alcohol); alcohols derived from linear $C_{10}$ to $C_{30}$ alpha olefins and mixtures thereof; and alcohols derived from polymers of $C_2$ to $C_6$ olefins, such as alcohols derived from polypropylene and polybutene, including polypropylene alcohols having about 9 to about 100 carbon atoms, and polybutylene alcohols having about 12 to about 100 carbon atoms. Preferred straight- or branched-chain aliphatic alcohols will contain about 1 to about 30 carbon atoms, more preferably about 2 to about 24 carbon atoms, and most preferably about 4 to about 12 carbon atoms. Particularly preferred aliphatic alcohols are butanols.

The phenols of formula IX may be monoalkyl-substituted phenols or dialkyl-substituted phenols. Monoalkyl-substituted phenols are preferred, especially monoalkylphenols having an alkyl substituent in the para position.

Preferably, the alkyl group of the alkylphenol will contain about 1 to about 30 carbon atoms, more preferably about 2 to about 24 carbon atoms, and most preferably about 4 to about 12 carbon atoms. Representative examples of phenols suitable for use in this invention include, but are not limited to, phenol, methylphenol, dimethylphenol, ethylphenol, butylphenol, octylphenol, decylphenol, dodecylphenol, tetradecylphenol, hexadecylphenol, octadecylphenol, eicosylphenol, tetracosylphenol, hexacosylphenol, triacontylphenol, and the like. Also, mixtures of alkylphenols may be employed, such as a mixture of $C_{14}$–$C_{18}$ alkylphenols, a mixture of $C_{18}$–$C_{24}$ alkylphenols, a mixture of $C_{20}$–$C_{24}$ alkylphenols, or a mixture of $C_{16}$–$C_{26}$ alkylphenols.

Particularly preferred alkylphenols are prepared by alkylating phenol with polymers or oligomers of $C_3$ to $C_6$ olefins, such as polypropylene or polybutene. These polymers typically contain about 8 to about 100 carbon atoms, preferably about 10 to about 30 carbon atoms. An especially preferred alkylphenol is prepared by alkylating phenol with a propylene polymer having an average of about 4 units. This polymer has the common name of propylene tetramer and is commercially available.

Finally, the poly(oxyalkylene) esters of the substituted polyphenylethers of the present invention may be prepared by reacting a compound of formula VI above, after deprotecting the hydroxy group, with an aromatic compound having the formula:

Formula X

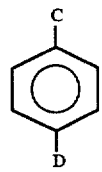

wherein C is a halide, preferably a chloride or fluoride, and more preferably fluoride, and D is cyano or nitro. Such aromatic compounds of formula X are well known to one skilled in the art to be readily available commercially. For example, these compounds can be purchased from Aldrich Chemical Company, Inc. The reaction of the hydroxy compound of formula VI with the cyano or nitro aromatic halide of formula X provides the poly(oxyalkylene) esters of the substituted polyphenylethers of formula XI.

Formula XI

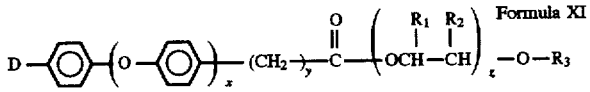

wherein D, $R_1$, $R_2$, $R_3$, X, y and z are as defined above.

Alternatively, compounds of the present invention can be prepared by esterifying a compound of formula XII below:

Formula XII

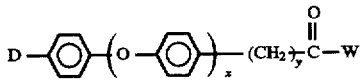

wherein D, x and y are as defined above and W is hydroxy or halogen, with a poly(oxyalkylene) mono-ol of formula III, above, under the esterification conditions described above. Compounds of formula XII wherein W is hydroxy are described, for example, in U.S. Pat. Nos. 3,642,882; 4,946,926 and 3,763,210.

The resulting cyano or nitro aromatic ethers may then be reduced to the corresponding amino or aminomethyl compound using conventional hydrogenation conditions well known in the art to yield the poly(oxyalkylene) esters of the substituted polyphenylethers of formula I. Hydrogenation of aromatic cyano and nitro groups are discussed in further detail in P. N. Rylander, *Catalytic Hydrogenation in Organic Synthesis,* Academic Press (1979).

Reductions can also be accomplished through the use of reducing metals in the presence of acids, such as hydrochloric acid. Typical reducing metals are zinc, iron, and tin; salts of these metals can also be used.

Typically, the amino or aminomethyl substituted polyphenylethers of the present invention are obtained by reduction of the corresponding cyano or nitro compound with hydrogen in the presence of a metallic catalyst such as palladium. This reduction is generally carried out at temperatures of about 20° C. to about 100° C., typically, about 20° C. to about 40° C., and hydrogen pressures of about atmospheric to about 200 psig, typically, about 20 to about 80 psig. The reaction time for reduction usually varies between about 5 minutes to about 24 hours. Substantially, inert liquid diluents and solvents, such as ethanol, cyclohexane, ethyl acetate, toluene, etc., can be used to facilitate the reaction. The substituted polyphenylether can then be obtained by well-known techniques such as distillation, filtration, extraction, and so forth.

The poly(oxyalkylene) esters of the substituted polyphenylethers of formula I wherein $R_3$ is hydrogen, i.e., compounds having the formula:

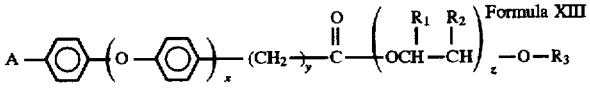

Formula XIII wherein A, $R_1$, $R_2$, x, y and z are as defined above, may be prepared from compounds of formula XI wherein $R_3$ is a labile hydrocarbyl group, such as a benzyl or t-butyl group, by removing the hydrocarbyl group under appropriate conditions to provide a hydroxyl group. For example, compounds of formula XI where $R_3$ represents a benzyl group may be prepared by employing a metal salt VII derived from benzyl alcohol in the above-described synthetic procedures. Cleavage of the benzyl ether using conventional hydrogenolysis procedures then provides a compound of formula XIII. Other labile hydrocarbyl groups, such as a t-butyl group, may be similarly employed for those compounds having functional groups that are not compatible with hydrogenolysis conditions, such as nitro groups. T-Butyl ethers may be cleaved under acidic conditions using, for example, trifluoroacetic acid.

When synthesizing the poly(oxyalkylene) esters of the substituted polyphenylethers of formula I having an amino group on the aromatic moiety (i.e., where A is an amino group), it is generally desirable to first prepare the corresponding nitro compound (i.e., where A is a nitro group) using the above-described synthetic procedures, and then to reduce the nitro group to an amino group using conventional procedures. Aromatic nitro groups may be reduced to amino groups using a number of procedures that are well known in the art. For example, aromatic nitro groups may be reduced under catalytic hydrogenation conditions; or by using a reducing metal, such as zinc, tin, iron, and the like, in the presence of an acid, such as dilute hydrochloric acid.

Generally, reduction of the nitro group by catalytic hydrogenation is preferred. Typically, this reaction is conducted using about 1 to about 4 atmospheres of hydrogen and a platinum or palladium catalyst, such as palladium on carbon. The reaction is typically carried out at a temperature of 0° C. to about 100° C. for about 1 to about 24 hours in an inert solvent, such as ethanol, ethyl acetate, and the like. Hydrogenation of aromatic nitro groups is discussed in further detail in, for example, P. N. Rylander, *Catalytic Hydrogenation in Organic Synthesis*, pp. 113–137, Academic Press (1979); and *Organic Synthesis, Collective Vol. I*, Second Edition, pp. 240–241, John Wiley & Sons, Inc. (1941); and references cited therein.

FUEL COMPOSITIONS

The poly(oxyalkylene) esters of the substituted polyphenylethers of the present invention are useful as additives in hydrocarbon fuels to prevent and control engine deposits, particularly intake valve deposits. Typically, the desired deposit control is achieved by operating an internal combustion engine with a fuel composition containing a poly (oxyalkylene) ester of a substituted polyphenylether of the present invention. The proper concentration of additive necessary to achieve the desired level of deposit control varies depending upon the type of fuel employed, the type of engine, and the presence of other fuel additives.

In general, the concentration of the poly(oxyalkylene) esters of the substituted polyphenylethers of this invention in hydrocarbon fuel will range from about 50 to about 2500 parts per million (ppm) by weight, preferably from about 75 to about 1000 ppm. When other deposit control additives are present, a lesser amount of the present additive may be used.

The poly(oxyalkylene) esters of the substituted polyphenylethers of the present invention may also be formulated as a concentrate using an inert stable oleophilic (i.e., dissolves in gasoline) organic solvent boiling in the range of about 150° F. to about 400° F. (about 65° C. to about 205° C.). Preferably, an aliphatic or an aromatic hydrocarbon solvent is used, such as benzene, toluene, xylene, or higher-boiling aromatics or aromatic thinners. Aliphatic alcohols containing about 3 to about 8 carbon atoms, such as isopropanol, isobutylcarbinol, n-butanol, and the like, in combination with hydrocarbon solvents are also suitable for use with the present additives. In the concentrate, the amount of the additive will generally range from about 10 to about 70 weight percent, preferably about 10 to about 50 weight percent, more preferably from about 20 to about 40 weight percent.

In gasoline fuels, other fuel additives may be employed with the additives of the present invention, including, for example, oxygenates, such as t-butyl methyl ether, anti-knock agents, such as methylcyclopentadienyl manganese tricarbonyl, and other dispersants/detergents, such as hydrocarbyl amines, hydrocarbyl poly(oxyalkylene) amines, or succinimides. Additionally, antioxidants, metal deactivators, and demulsifiers may be present.

In diesel fuels, other well-known additives can be employed, such as pour point depressants, flow improvers, cetane improvers, and the like.

A fuel-soluble, nonvolatile carrier fluid or oil may also be used with the poly(oxyalkylene) esters of the substituted polyphenylethers of this invention. The carrier fluid is a chemically inert hydrocarbon-soluble liquid vehicle which substantially increases the nonvolatile residue (NVR), or solvent-free liquid fraction of the fuel additive composition while not overwhelmingly contributing to octane requirement increase. The carrier fluid may be a natural or synthetic oil, such as mineral oil, refined petroleum oils, synthetic polyalkanes and alkenes, including hydrogenated and unhydrogenated polyalphaolefins, synthetic polyoxyalkylene-derived oils, such as those described, for example, in U.S. Pat. No. 4,191,537 to Lewis, and polyesters, such as those described, for example, in U.S. Pat. Nos. 3,756,793 and 5,004,478 to Robinson and Vogel et al., respectively, and in European Patent Application Nos. 356,726 and 382,159, published Mar. 7, 1990 and Aug. 16, 1990, respectively.

These carrier fluids are believed to act as a carrier for the fuel additives of the present invention and to assist in removing and retarding deposits. The carrier fluid may also exhibit synergistic deposit control properties when used in combination with a poly(oxyalkylene) ester of a substituted polyphenylether of this invention.

The carrier fluids are typically employed in amounts ranging from about 100 to about 5000 ppm by weight of the hydrocarbon fuel, preferably from about 400 to about 3000 ppm of the fuel. Preferably, the ratio of carrier fluid to deposit control additive will range from about 0.5:1 to about 10:1, more preferably from about 1:1 to about 4:1, most preferably about 2:1.

When employed in a fuel concentrate, carrier fluids will generally be present in amounts ranging from about 20 to about 60 weight percent, preferably from about 30 to about 50 weight percent.

EXAMPLES

The following examples are presented to illustrate specific embodiments of the present invention and synthetic preparations thereof; and therefore these examples should not be interpreted as limitations upon the scope of this invention.

Example 1

Preparation Of

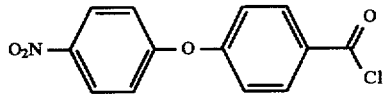

To a flask equipped with a magnetic stirrer and drying tube was added 4-(4'-nitrophenoxy)benzoic acid (10.0 grams, prepared essentially as described in Example 3 of U.S. Pat. No. 3,642,882), anhydrous dichloromethane (100 mL), and oxalyl chloride (8.4 mL). N,N-Dimethylformamide (one drop) was then added. The resulting mixture was stirred at room temperature for 16 hours and the solvent removed in vacuo to yield 10.7 grams of the desired acid chloride as a yellow solid.

Example 2

Preparation Of

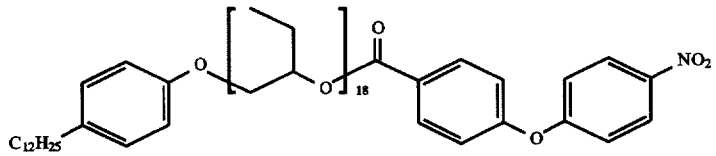

4-(4'-nitrophenoxy)benzoyl chloride (10.7 grams, from Example 1), α-hydroxy-ω-4-dodecylphenoxypoly (oxybutylene) having an average of 18 oxybutylene units (57.2 grams, prepared essentially as described in Example 6 of U.S. Pat. No. 4,160,648), 4-dimethylaminopyridine (4.9 grams) and anhydrous chloroform (200 mL) were combined. The resulting mixture was refluxed under nitrogen for 16 hours. The reaction was diluted with 600 mL of dichloromethane and was washed twice with one percent aqueous hydrochloric acid, twice with saturated aqueous sodium bicarbonate solution and once with brine. The organic layer was dried over anhydrous magnesium sulfate, filtered and the solvents removed in vacuo to yield 62.7 grams of the desired product as a light yellow oil. $^1$H NMR ($CDCl_3$) d 8.25 (AB quartet, 2H), 8.1 (AB quartet, 2H), 7.0–7.25 (m, 6H), 6.75–6.9 (m, 2H), 5.1–5.25 (m, 1H), 3.05–4 (m, 53H), 0.6–1.8 (m, 115H).

Example 3

Preparation Of

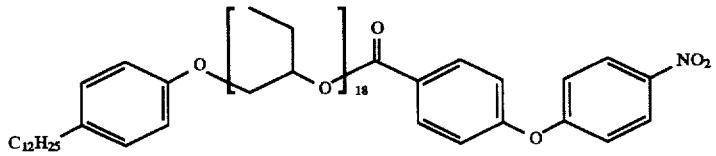

A solution of 58.1 grams of the product from Example 2 in 600 mL of ethyl acetate containing 3.0 grams of 10% palladium on charcoal was hydrogenolyzed at 35–40 psi for 16 hours on a Parr low-pressure hydrogenator. Catalyst filtration and removal of the solvent in vacuo yield 52.8 grams as a yellow oil. $^1$H NMR ($CDCl_3$, $D_2O$) d 7.95 (d, 2H), 6.75–7.25 (m, 8H), 6.7 (d, 2H), 5.05–5.2 (m, 1H), 3.05–4 (m, 53H), 0.6–1.8 (m, 115H).

Example 4

Single-Cylinder Engine Test

The test compounds were blended in gasoline and their deposit reducing capacity determined in an ASTM/CFR single-cylinder engine test.

A Waukesha CFR single-cylinder engine was used. Each run was carried out for 15 hours, at the end of which time the intake valve was removed, washed with hexane and weighed. The previously determined weight of the clean valve was subtracted from the weight of the value at the end of the run. The differences between the two weights is the weight of the deposit. A lesser amount of deposit indicates a superior additive. The operating conditions of the test were as follows: water jacket temperature 200 ° F.; vacuum of 12 in Hg, air-fuel ratio of 12, ignition spark timing of 400 BTC; engine speed is 1800 rpm; the crankcase oil is a commercial 30 W oil.

The amount of carbonaceous deposit in milligrams on the intake valves is reported for each of the test compounds in Table I.

TABLE I

| | Intake Valve Deposit Weight (in milligrams) | | |
|---|---|---|---|
| Sample[1] | Run 1 | Run 2 | Average |
| Base Fuel | 337.7 | 351 | 344.4 |
| Example 2 | 228.4 | 222.4 | 225.4 |
| Example 3 | 34.9 | 24.9 | 29.9 |

[1]At 150 parts per million actives (ppma).

The base fuel employed in the above single-cylinder engine tests was a regular octane unleaded gasoline containing no fuel detergent. The test compounds were admixed with the base fuel to give the concentrations indicated in the table.

The data in Table I illustrates the significant reduction in intake valve deposits provided by the poly(oxyalkylene) esters of the substituted polyphenylethers of the present invention (Examples 2 and 3) compared to the base fuel.

What is claimed is:

1. A compound of the formula:

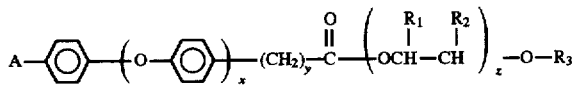

wherein A is amino, aminomethyl, cyano, nitro, N-alkylamino or N-alkylaminomethyl wherein the alkyl group contains about 1 to about 6 carbon atoms, or N,N-dialkylamino or N,N-dialkylaminomethyl wherein each alkyl group independently contains about 1 to about 6 carbon atoms;

$R_1$ and $R_2$ are independently hydrogen or lower alkyl having about 1 to about 6 carbon atoms and each $R_1$ and $R_2$ is independently selected in each —O—$CHR_1$-$CHR_2$- unit;

$R_3$ is hydrogen, alkyl having about 1 to about 100 carbon atoms, phenyl, aralkyl having about 7 to about 100 carbon atoms, or alkaryl having about 7 to about 100 carbon atoms;

x is an integer from 1 to about 10; y is an integer from 0 to about 10; and z is an integer from about 1 to about 100.

2. The compound according to claim 1, wherein A is amino or aminomethyl.

3. The compound according to claim 2, wherein A is amino.

4. The compound according to claim 1, wherein one of $R_1$ and $R_2$ is lower alkyl having about 1 to about 3 carbon atoms and the other is hydrogen.

5. The compound according to claim 4, wherein one of $R_1$ and $R_2$ is methyl or ethyl and the other is hydrogen.

6. The compound according to claim 1, wherein $R_3$ is hydrogen, alkyl having about 1 to about 30 carbon atoms, or alkylphenyl having an alkyl group containing about 1 to about 30 carbon atoms.

7. The compound according to claim 6, wherein $R_3$ is hydrogen, alkyl having about 2 to about 24 carbon atoms, or alkylphenyl having an alkyl group containing about 2 to about 24 carbon atoms.

8. The compound according to claim 1, wherein x is 1 and y is 0.

9. The compound according to claim 1, wherein z is an integer ranging from about 1 to about 50.

10. The compound according to claim 9, wherein z is an integer ranging from about 1 to about 30.

11. A fuel composition comprising a major amount of hydrocarbons boiling in the gasoline or diesel range and an effective deposit-controlling amount of a compound of the formula:

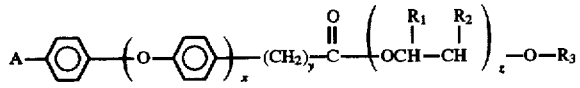

wherein A is amino, aminomethyl, cyano, nitro, N-alkylamino or N-alkylaminomethyl wherein the alkyl group contains about 1 to about 6 carbon atoms, or N,N-dialkylamino or N,N-dialkylaminomethyl wherein each alkyl group independently contains about 1 to about 6 carbon atoms;

$R_1$ and $R_2$ are independently hydrogen or lower alkyl having about 1 to about 6 carbon atoms and each $R_1$ and $R_2$ is independently selected in each —O—$CHR_1$-$CHR_2$- unit;

$R_3$ is hydrogen, alkyl having about 1 to about 100 carbon atoms, phenyl, aralkyl having about 7 to about 100 carbon atoms, or alkaryl having about 7 to about 100 carbon atoms;

x is an integer from 1 to about 10; y is an integer from 0 to about 10; and z is an integer from about 1 to about 100.

12. The fuel composition according to claim 11, wherein A is amino or aminomethyl.

13. The fuel composition according to claim 12, wherein A is amino.

14. The fuel composition according to claim 11, wherein one of $R_1$ and $R_2$ is lower alkyl having about 1 to about 3 carbon atoms and the other is hydrogen.

15. The fuel composition according to claim 14, wherein one of $R_1$ and $R_2$ is methyl or ethyl and the other is hydrogen.

16. The fuel composition according to claim 11, wherein $R_3$ is hydrogen, alkyl having about 1 to about 30 carbon atoms, or alkylphenyl having an alkyl group containing about 1 to about 30 carbon atoms.

17. The fuel composition according to claim 16, wherein $R_3$ is hydrogen, alkyl having about 2 to about 24 carbon atoms, or alkylphenyl having an alkyl group containing about 2 to about 24 carbon atoms.

18. The fuel composition according to claim 11, wherein x 1 and y is 0.

19. The fuel composition according to claim 11, wherein z is an integer ranging from about 1 to about 50.

20. The fuel composition according to claim 19, wherein z is an integer ranging from about 1 to about 30.

21. The fuel composition according to claim 11, wherein said composition contains about 50 to about 2500 parts per million by weight of said compound.

22. The fuel composition according to claim 21, wherein said composition further contains about 100 to about 5000 parts per million by weight of a fuel soluble, non-volatile carrier fluid.

23. A method for reducing engine deposits in an internal combustion engine comprising operating an internal combustion engine with the fuel composition of claim 11.

24. A fuel concentrate comprising an inert stable oleophilic organic solvent boiling in the range of from about 150° F. to about 400° F. and from about 10 to about 70 weight percent of a compound of the formula:

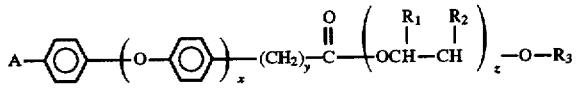

wherein A is amino, aminomethyl, cyano, nitro, N-alkylamino or N-alkylaminomethyl wherein the alkyl group contains about 1 to about 6 carbon atoms, or N,N-dialkylamino or N,N-dialkylaminomethyl wherein each alkyl group independently contains about 1 to about 6 carbon atoms;

$R_1$ and $R_2$ are independently hydrogen or lower alkyl having about 1 to about 6 carbon atoms and each $R_1$ and $R_2$ is independently selected in each -O-CHR$_1$-CHR$_2$- unit;

$R_3$ is hydrogen, alkyl having about 1 to about 100 carbon atoms, phenyl, aralkyl having about 7 to about 100 carbon atoms, or alkaryl having about 7 to about 100 carbon atoms;

x is an integer from 1 to about 10, y is an integer from 0 to about 10; and z is an integer from about 1 to about 100.

25. The fuel concentrate according to claim 24, wherein A is amino or aminomethyl; one of $R_1$ and $R_2$ is hydrogen and the other is methyl or ethyl; $R_3$ is hydrogen, alkyl having about 1 to about 30 carbon atoms or alkylphenyl having an alkyl group containing about 1 to about 30 carbon atoms; x is 1, y is 0, and z is about 1 to about 50.

26. The fuel concentrate according to claim 25, wherein A is amino, $R_3$ is hydrogen, alkyl having about 2 to about 24 carbon atoms or alkylphenyl having an alkyl group containing about 2 to about 24 carbon atoms; x is 1, y is 0, and z is about 1 to about 50.

27. The fuel concentrate according to claim 24, wherein the fuel concentrate further contains from about 20 to about 60 weight percent of a fuel-soluble, nonvolatile carrier fluid.

* * * * *